US007290850B2

(12) United States Patent
Nishino

(10) Patent No.: US 7,290,850 B2
(45) Date of Patent: Nov. 6, 2007

(54) INK JET RECORDING APPARATUS

(75) Inventor: Satoshi Nishino, Sayama (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 318 days.

(21) Appl. No.: 11/038,423

(22) Filed: Jan. 20, 2005

(65) Prior Publication Data

US 2005/0168518 A1 Aug. 4, 2005

(30) Foreign Application Priority Data

Jan. 30, 2004 (JP) ..... 2004-022997

(51) Int. Cl.
*B41J 2/165* (2006.01)
*B41J 2/01* (2006.01)

(52) U.S. Cl. ..... 347/29; 347/32; 347/102

(58) Field of Classification Search ..... 347/22, 347/24, 29, 30, 32, 100, 102
See application file for complete search history.

(56) References Cited

U.S. PATENT DOCUMENTS 5,040,000 A * 8/1991 Yokoi ..... 347/30
5,051,761 A * 9/1991 Fisher et al. ..... 347/30
5,467,114 A * 11/1995 Ebinuma et al. ..... 347/32
6,357,851 B1 * 3/2002 Gaasch ..... 347/33
6,783,227 B2 * 8/2004 Suzuki et al. ..... 347/102
6,843,550 B2 * 1/2005 Waller et al. ..... 347/29
7,137,695 B2 * 11/2006 Yokoyama ..... 347/102

FOREIGN PATENT DOCUMENTS

JP 59115863 * 12/1982

* cited by examiner

*Primary Examiner*—Shih-Wen Hsieh
(74) *Attorney, Agent, or Firm*—Lucas & Mercanti, LLP

(57) ABSTRACT

An ink jet recording apparatus, including: (1) a recording head to eject ink which is hardened by irradiation of ultraviolet rays; (2) an ultraviolet ray irradiation section to harden the ink ejected from the recording head; and (3) a recording head maintenance device, including, (3-1) a maintenance section for carrying out maintenance of the recording head; (3-2) a coupling section to make the recording head maintenance device to come into close contact with the recording head; and (3-3) a cover section to cover the maintenance section, on which an opening section is formed to make the coupling section to project beyond the maintenance unit cover, including a light shield section to shield the coupling section from the ultraviolet rays emerging from the ultraviolet ray irradiation section.

8 Claims, 9 Drawing Sheets

7b

7c

7d

INK JET RECORDING APPARATUS

BACKGROUND OF THE INVENTION

The present invention relates to ink jet recording apparatuses and particularly to ink jet recording apparatuses using ultraviolet ray hardening type inks.

Conventionally, compared to the gravure printing method and the flexo-graphic printing method, ink jet recording apparatuses have come to be used widely because it is possible to reduce the cost when carrying out small-lot printing jobs since no plate making process is necessary, because it is possible to print on various types and sizes of recording media, and because images equal in quality to silver halide photographs, and other reasons.

In recent years, in such ink jet recording apparatuses, ultraviolet ray hardening type inks such as radical polymerization type inks or cation polymerization type inks are being used because it is possible to print on various types of printing media using such ink jet apparatuses, and several recording heads of each color have come to be arranged in ink jet recording apparatuses in order to carry out high quality and high speed printing on still wider range of types of recording media.

However, when recording is done using plural recording heads, there is the problem that ink clogging occurs in the nozzles of the recording heads due to ink remaining in the recording head or due to paper dust or paper waste accumulated near the nozzles, thereby causing degradation of the image quality due to ink dot dropouts.

In view of this, as is indicated in Patent Document 1, there have been proposals to provide maintenance apparatuses in ink jet recording apparatuses to carry out maintenance of the recording heads. In the maintenance head of such a maintenance apparatus, the cap bases (which are coupling sections) for carrying out the maintenance tasks of suctioning the ink in the recording heads of each color are arranged to correspond to the recording heads of different colors that are arranged in a zigzag manner while being adjacent to each other. Thus, deterioration in the recorded image quality is attempted to be prevented by preventing nozzle clogging by carrying out maintenance of all the plural recording heads using this maintenance apparatus.

Patent Document 1: Japanese Patent Application Laid Open No. 2003-127407

However, as is indicated in Patent Document 1, there is the problem that arranging the same number of maintenance units in the maintenance apparatus as the number of recording heads not only increases the manufacturing cost but also makes the maintenance apparatus very large in an ink jet recording apparatus requiring a large number of recording heads.

Further, in the conventional maintenance apparatuses, since no cover for preventing exposure to ultraviolet rays from the ultraviolet ray irradiating apparatus had been provided and since light shut off measures were insufficient, the ink remaining in or the ink adhering to the cap bases become hardened due to the ultraviolet ray irradiation during the operation of the ink jet recording apparatus or due to the ultraviolet rays in the ambient natural light, particularly in the case of ultraviolet ray hardening cation type inks that are more susceptible to accumulate optical activation energies. Because of this, there was the problem that it is not possible to carry out thoroughly the maintenance operations such as suction using cap bases etc., thereby leading to defects of the ink jet recording apparatus.

SUMMARY OF THE INVENTION

The present invention has been made considering the aspects described above, and the purpose of the present invention is to provide an ink jet recording apparatus in which it is possible to carry out maintenance thoroughly even when image recording at high speeds and high image qualities is made and in which not only the manufacturing cost of the maintenance apparatus is lowered but also the size of the maintenance apparatus is made small. The above-mentioned object is attained by any one of the structures stated below.

Structure 1

In order to solve the above problems, the present invention proposes an ink jet recording apparatus with the feature that, in an ink jet recording apparatus comprising a recording head of the ink jet type in which ink hardening upon irradiation with ultraviolet rays is ejected, and an ultraviolet ray irradiation apparatus for hardening the ink ejected from said recording head; a maintenance apparatus is provided comprising a maintenance unit for carrying out maintenance of said recording head and a maintenance unit cover that covers said maintenance unit, with said maintenance unit cover having an opening section for making a cap base (which is a coupling section) provided in said maintenance unit to project beyond said maintenance unit cover and to come into close contact with said recording head, and with said opening section being provided with a light shutter plate for shutting off said cap base from the ultraviolet rays emerging from said ultraviolet ray irradiation apparatus.

According to the present invention described in Structure 1, in said maintenance apparatus, because said maintenance unit cover not only has an opening section for making said cap base provided in said maintenance unit to project beyond said maintenance unit cover and to come into close contact with said recording head but also because said opening section is provided with a light shutter plate for shutting off said cap base from the ultraviolet rays emerging from said ultraviolet ray irradiation apparatus, it is possible to shut off the ultraviolet rays from illuminating said cap base.

Structure 2

The invention according to Structure 2 has the feature that in said ink jet recording apparatus described in Structure 1 above, said control apparatus is provided that executes the control of making the maintenance of said recording heads to be carried out by moving said maintenance unit of said maintenance apparatus during maintenance to said opening section.

According to the invention described in Structure 2, because said control apparatus is provided that executes the control of making the maintenance of said recording heads to be carried out by moving said maintenance unit of said maintenance apparatus during maintenance to said opening section, not only the ultraviolet light illuminating said cap base is shut off but also it is possible to carry out maintenance using lesser number of maintenance units than the number of said recording heads.

Structure 3

The invention according to Structure 3 has the feature that in said ink jet recording apparatus described in Structure 1 or Structure 2 above, said maintenance unit cover is provided with said light shut off plate that covers a top surface of said cap base (which is a coupling section).

According to the invention described in Structure 3, in said ink jet recording apparatus, because said light shut off plate is provided so as to cover a top surface of said cap base, it is possible to shut off ultraviolet rays from said ultraviolet ray irradiation apparatus of said ink jet recording apparatus or from natural ambient light from impinging on the ink remaining or adhering to said cap base at all times except during maintenance.

Structure 4

The invention according to Structure 4 has the feature that, in said ink jet recording apparatus described in Structure 3 above, said light shut off plate is formed with larger dimensions than the height and width dimensions of said cap base.

According to the invention described in Structure 4, in said ink jet recording apparatus, because said light shut off plate is formed with larger dimensions than the height and width dimensions of said cap base, it is possible to shut off the ultraviolet rays impinging through said opening section, and, in particular, in said ink jet recording apparatus using ultraviolet ray hardening type of inks, it is possible to shut off the ultraviolet rays radiated from said ultraviolet ray irradiation apparatus from impinging on said cap base.

Structure 5

The invention according to Structure 5 has the feature that, in said ink jet recording apparatus described in any one of Structure 1 to Structure 4 above, said recording head comprises three recording heads arranged in a zigzag manner along the vertical scanning direction Y.

According to the invention described in Structure 5, in said ink jet recording apparatus, it is possible to carry out maintenance with fewer number of said maintenance units compared to the case in which the number of maintenance units would increase due to said maintenance units also being arranged in a zigzag manner corresponding to said recording head having a configuration in which three recording heads are arranged in a zigzag manner along the vertical scanning direction Y.

Structure 6

The invention according to Structure 6 has the feature that, in said ink jet recording apparatus described in any one of Structure 1 to Structure 5 above, an O-ring (which is a sealing member) is provided in said cap base for making said cap base come into close contact with said recording head, and that the material used for said O-ring is perfluoro-elastomer.

According to the invention described in Structure 6, because said O-ring is provided in said cap base of said maintenance unit for making said cap base come into close contact with said recording head, and because the material used for said O-ring is perfluoro-elastomer, not only the replacement becomes easy but also durability over long periods can be obtained without any dissolving, bloating up or becoming slippery due to the chemical constituents contained in the ink.

Structure 7

The invention according to Structure 7 has the feature that, in said ink jet recording apparatus described in any one of Structure 1 to Structure 6 above, said ink used is one having a viscosity of 10 to 50 mPa·s and a surface tension of 20 to 40 mN/m at 25° C.

According to the invention described in Structure 7, in said ink jet recording apparatus, it is possible to use inks having a viscosity of 10 to 50 mPa·s and a surface tension of 20 to 40 mN/m at 25° C.

Structure 8

The invention according to Structure 8 has the feature that, in said ink jet recording apparatus described in any one of Structure 1 to Structure 7 above, said ink used is of the ultraviolet ray hardening type.

According to the invention described in Structure 8, in said ink jet recording apparatus, it is possible to use inks of the ultraviolet ray hardening type.

DETAILED DESCRIPTION OF THE PREFERRED EMBODIMENT

A preferred embodiment of the ink jet recording apparatus according to the present invention is described below referring to FIG. 1 to FIG. 11. However, the following is merely one example of the preferred embodiments of the present invention and the descriptions given here are not to be construed to limit the scope and intent of the present invention to this example in any manner.

Figure 1:
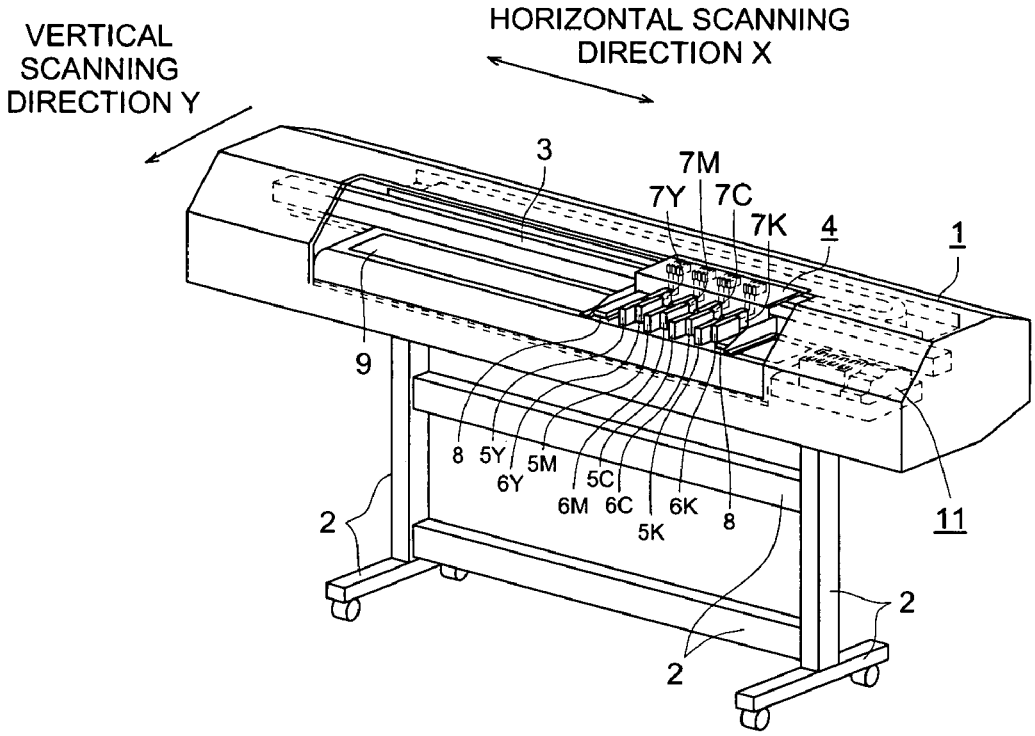
FIG. 1. A perspective view of the ink jet recording apparatus according to the present invention.

FIG. 1 is a perspective view of the ink jet recording apparatus according to the present preferred embodiment. Said ink jet recording apparatus is provided with a printer main unit 1 and a supporting table 2 that supports the printer main unit 1. The rod shaped guide rail 3 is provided in the printer main unit 1, and the carriage 4 is supported by this guide rail. This carriage 4 is made to carry out reciprocating movement in the horizontal scanning direction X along the guide rail 3 by a drive mechanism not shown in the figure.

Figure 8:
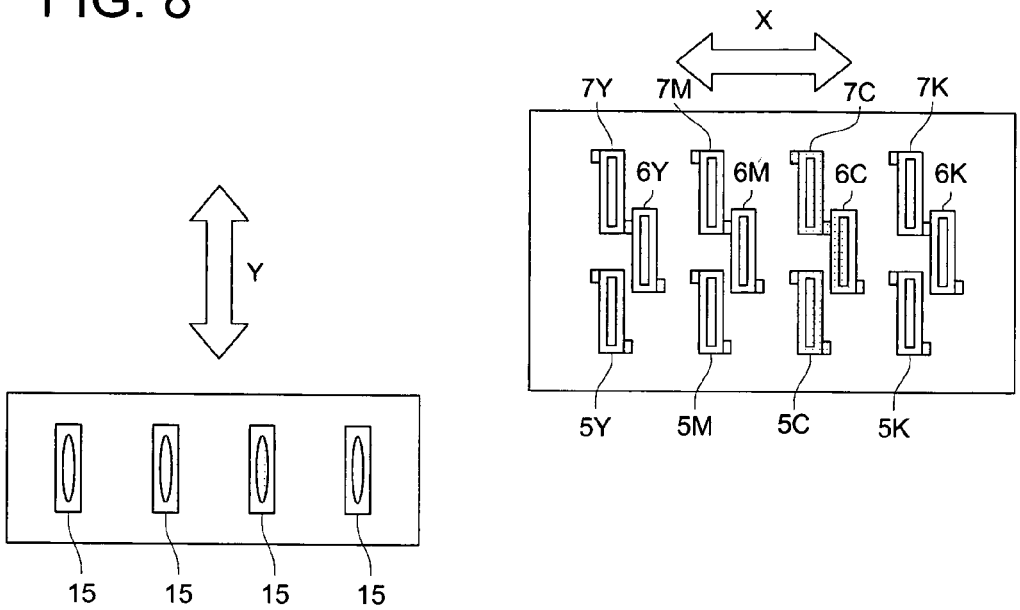
FIG. 8. The outline diagram of the maintenance process according to the present invention at the time of starting and stopping.

As is shown in FIG. 1 and FIG. 8, the carriage 4 has mounted on it the recording heads 5Y, 6Y, 7Y, 5M, 6M, 7M, 5C, 6C, 7C, and 5K, 6K, 7K, having ejection outlets for ejecting inks of each of the colors yellow (Y), magenta (M), cyan (C), and black (K). Three recording heads for each color in these recording heads are arranged in a zigzag manner in a direction (vertical scanning direction Y) at right angles to the horizontal scanning direction X. Each of said recording heads 5Y, 6Y, 7Y, 5M, 6M, 7M, 5C, 6C, 7C, and 5K, 6K, 7K are connected respectively to ink tanks (not shown in the figure) that store inks of each of the colors yellow (Y), magenta (M), cyan (C), and black (K).

Further, ultraviolet ray irradiation apparatuses 8 that radiate ultraviolet rays towards the ink ejected from the ejection outlet onto the recording medium are provided on both sides of the recording heads 5Y, 6Y, 7Y, 5M, 6M, 7M, 5C, 6C, 7C, and 5K, 6K, 7K, along the horizontal scanning direction X of the carriage 4.

Further, a transport mechanism (not shown in the figure) that feeds the recording medium along the vertical scanning direction Y is provided on the printer main unit 1. The transport mechanism is provided with, for example, a transport motor not shown in the figure and transport rollers etc, and the recording medium is transported along the vertical scanning direction Y by rotating the transport rollers by driving the transport motor. Further, the transport mechanism, during image recording, transports the recording medium intermittently by repeating transportation and stopping of the recording medium, coordinating with the operation of the carriage.

In addition, a flat plate shaped platen 9 that supports the recording medium from the non-recording surface is provided in the lower recording area of the carriage 4.

A home area for holding the recording heads 5Y, 6Y, 7Y, 5M, 6M, 7M, 5C, 6C, 7C, and 5K, 6K, 7K, mounted on the carriage 4 in the standby state is provided at one end of the movement area of the carriage 4 of said inkjet recording apparatus.

A maintenance area for carrying out the maintenance of the recording heads 5Y, 6Y, 7Y, 5M, 6M, 7M, 5C, 6C, 7C, and 5K, 6K, 7K mounted on the carriage 4 is provided at the other end of the movement area of the carriage 4 of said ink jet recording apparatus. A maintenance apparatus 11 for carrying out maintenance for each color of the recording heads 5Y, 6Y, 7Y, 5M, 6M, 7M, 5C, 6C, 7C, and 5K, 6K, 7K, of the carriage 4 is provided in said maintenance area of said ink jet recording apparatus.

Figure 2:
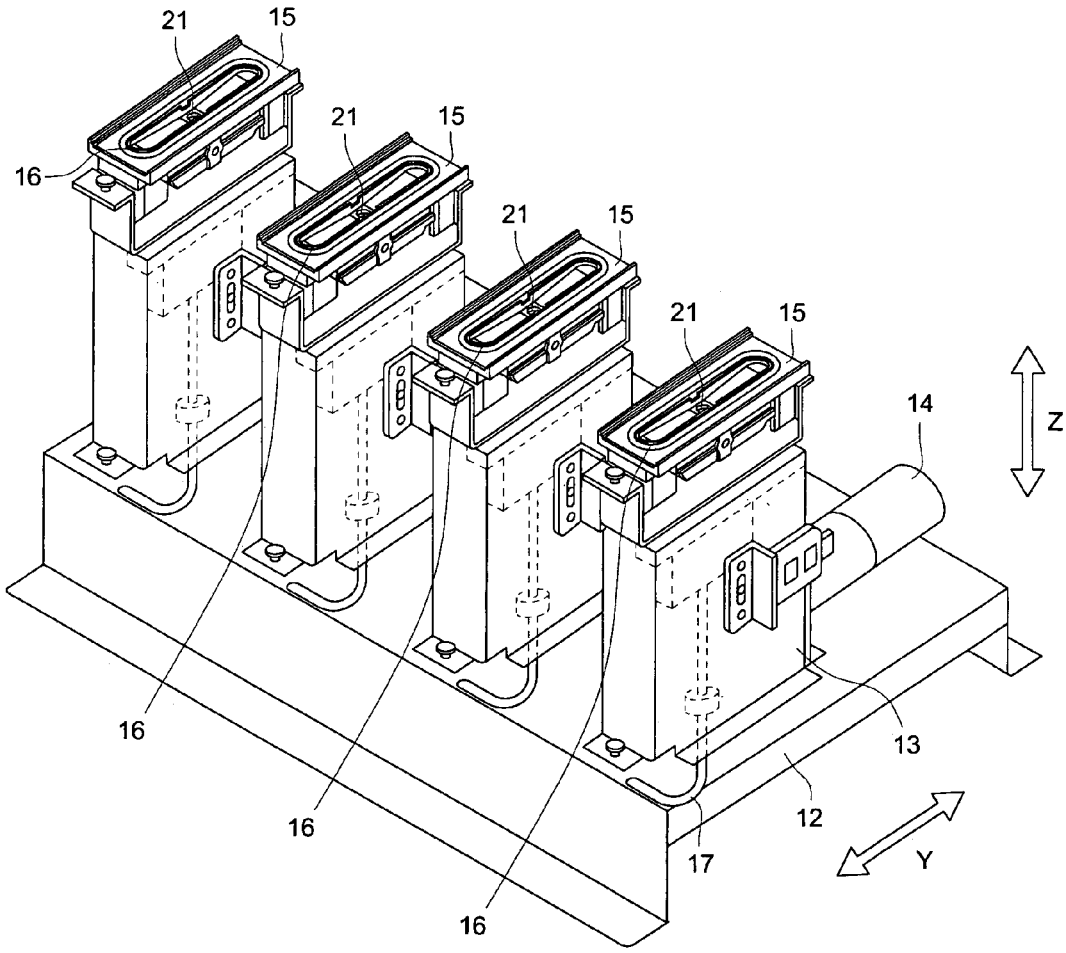
FIG. 2. A perspective view of the interior of the maintenance apparatus according to the present invention.

As is shown in FIG. 2, said maintenance apparatus 11 is provided with four maintenance units arranged along the horizontal scanning direction X so as to correspond to the recording heads of each of the colors Y, M, C, and K, and is also provided with a unit transporting table 12 that not only supports each of said maintenance units but also carries out their reciprocating movement along the vertical scanning direction Y.

This unit transporting table 12 is configured so that it is free to move in the vertical scanning direction Y along a rail not shown in the figure, and a transport mechanism not shown in the figure is provided in this unit transporting table 12. This transport mechanism is configured, for example, to comprise a rack placed along said rail, and a pinion that mates with said rack and whose rotation is driven by a drive motor not shown in the figure but installed on the unit transporting table 12, and the unit transporting table 12 can be moved in a reciprocating manner along the rail by moving the pinion with respect to the rack by driving the rotation of the pinion using the drive motor.

As is shown in FIG. 2 and FIG. 8, each maintenance unit comprises the cap base 15 that covers the nozzle surface of the recording heads 5, 6, 7 for each color, and a supporting table 13 that supports the cap base 15. This supporting table 13 is provided with the lift mechanism 14 that raises and lowers the cap base 15, and the lift mechanism 14 is configured to comprise a lift motor, and an eccentric cam whose rotation is driven by the drive from this lift motor while maintaining contact with the bottom surface of the cap base 15. Thus, it is possible to carry out the raising and lowering operations (in direction Z) of the cap base 15 by driving the rotation of the eccentric cam using the drive of the lift mechanism 14.

Figure 3:
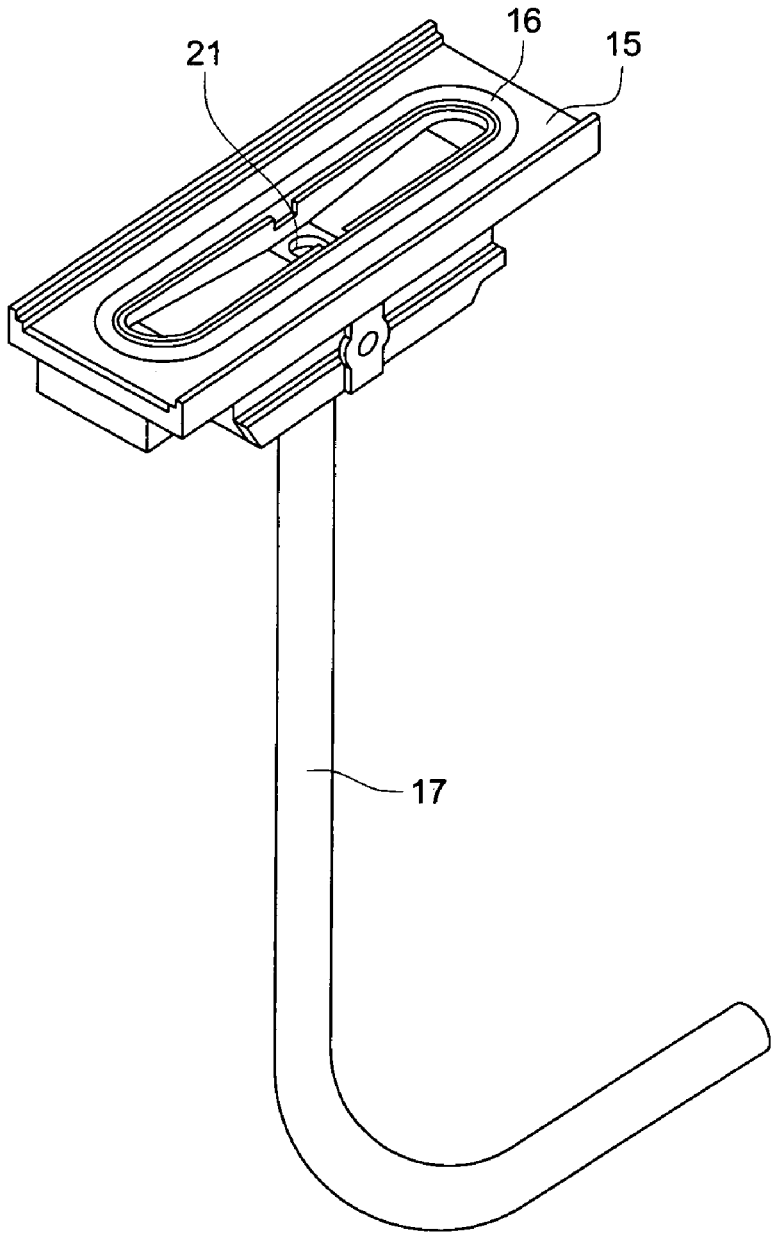
FIG. 3. A perspective view of the maintenance mechanism of the cap base of the maintenance unit according to the present invention.

As is shown in FIG. 3, the top surface of the cap base 15 is provided with a groove having the shape of a rounded-rectangle, and an O-ring 16 that comes into close contact with the nozzle surface of the recording heads 5, 6, 7 at the time of carrying out maintenance has been press-fitted inside this groove. The performance characteristics of this O-ring 16 can be sustained for a long period by selecting its material to have resistance to chemicals, thermal stability, and ability to withstand corrosion, and it is desirable to use for this material a perfluoro-elastomer which does not bloat up or become slippery particularly when it comes into contact with cation polymerization type inks.

Further, a suction hole 21 that sucks ink from the nozzles of the recording heads 5, 6, 7 is provided at the center of this groove and a tube 17 is connected to this suction hole 21. A suction pump (not shown in the figure) is introduced at the middle part of this tube 17 and a waste ink tank (not shown in the figure) that collects the ink sucked by the suction pump is connected to the other end of the tube 17.

Figure 4:
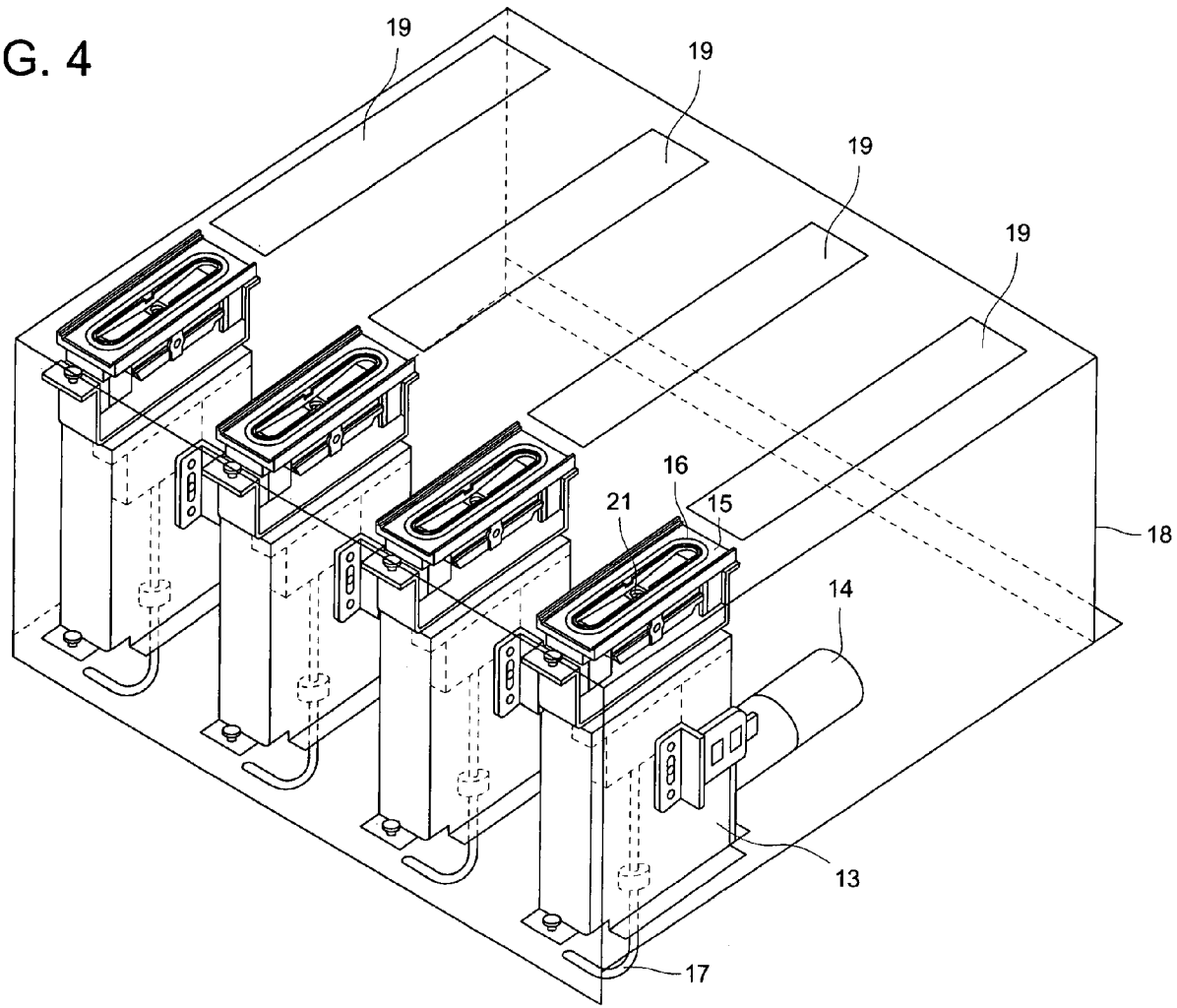
FIG. 4. A perspective external view when the maintenance unit is stored in the maintenance apparatus according to the present invention.

As is shown in FIG. 4, a maintenance unit cover 18 that shuts out ultraviolet rays emitted from the ultraviolet ray irradiation unit 8 is provided on the outside of the maintenance unit of said maintenance apparatus 11. The position of the top surface of this maintenance cover unit 18 has been arranged to be lower than the position of the top surface of the platen 9 so that the cap bases 15, 15, . . . of the maintenance unit can come into close contact with the nozzle surface of the recording heads 5Y, 6Y, 7Y, 5M, 6M, 7M, 5C, 6C, 7C, and 5K, 6K, 7K. The inner and the outer surfaces of said maintenance unit cover 18 should desirably be coated with black alumite which has low reflectivity for the impinging ultraviolet rays.

Figure 5:
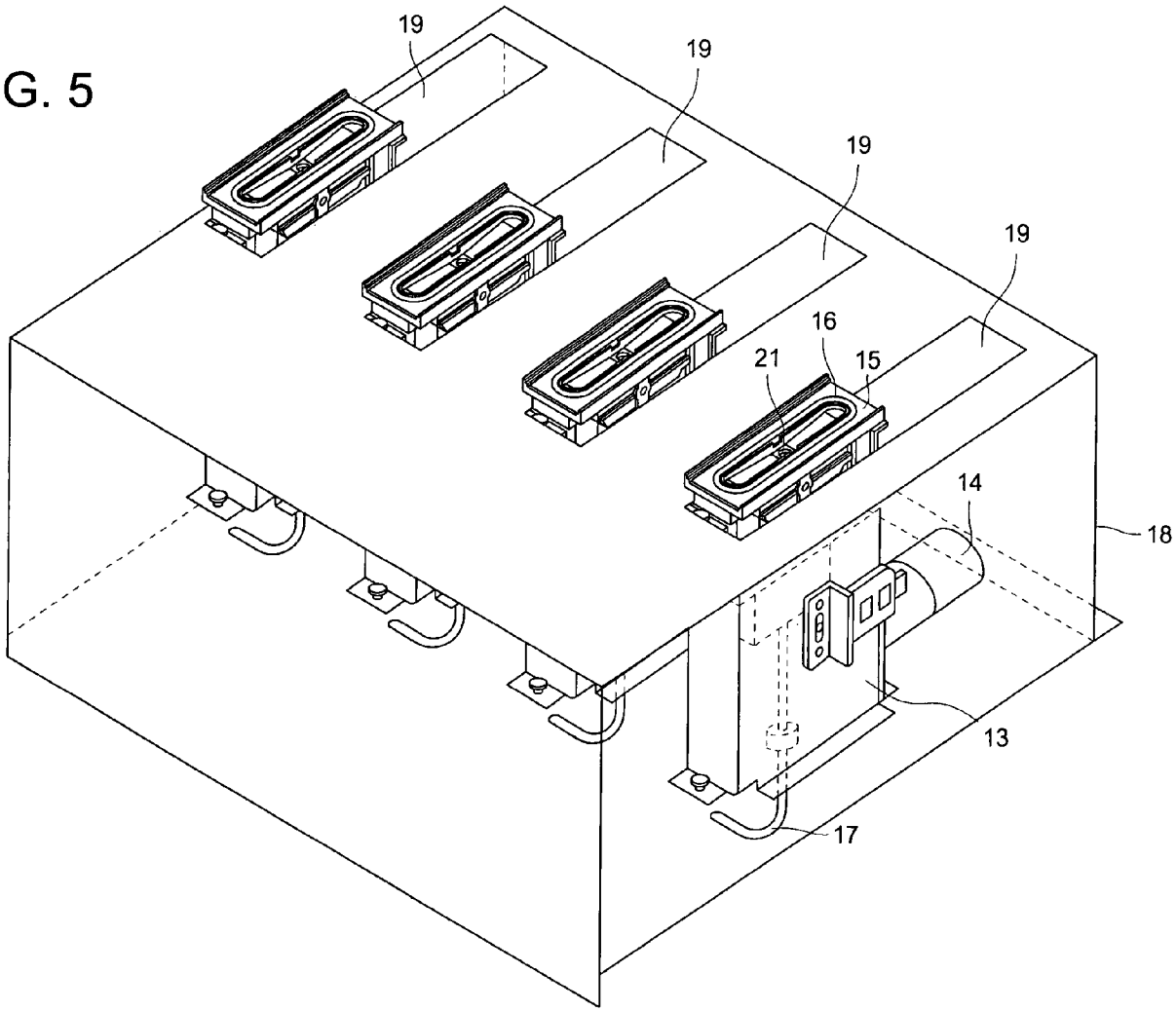
FIG. 5. A perspective external view of the maintenance according to the present invention during maintenance.

As is shown in FIG. 4 and FIG. 5, four opening sections 19 corresponding to each unit are provided on the top surface of said maintenance unit cover 18. As is shown in FIG. 5, the width dimension of each of this opening sections 19 is set so that the cap base 15 of the maintenance unit can pass through it, and the length dimension of the opening section 19 is set so that it corresponds to the overall lengths of each of the recording heads 5, 6, 7 arranged along the vertical scanning direction Y. Further, the part of the inner side of the maintenance unit cover in which the opening section 19 has not been formed is taken as the standby position of the maintenance unit, and the maintenance unit is made to standby at a position at which the top surface of the cap base comes close to the inner side of the top surface of the maintenance unit cover. Further, it is desirable that this opening section 19 is formed to have a small size so that the ultraviolet rays from the ultraviolet irradiation apparatus 8 do not impinge on the maintenance unit inside.

Figure 6:
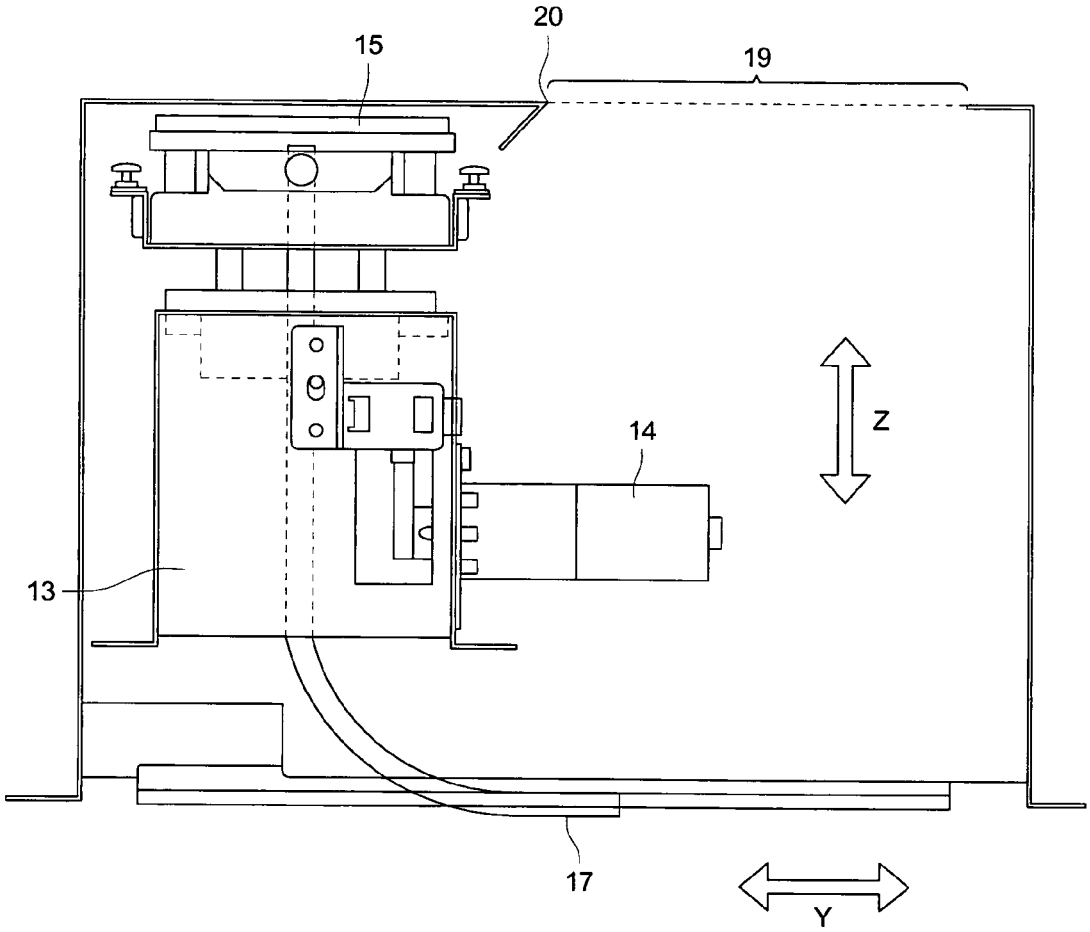
FIG. 6. A perspective side view when the maintenance unit is stored in the maintenance apparatus according to the present invention.

As is shown in FIG. 6, the light shut off plate 20 that shuts off the ultraviolet rays impinging on the cap base 15 is formed by bending at the end on the side of said standby position of the opening section 19 of said maintenance unit cover. This light shut off plate 20, as is shown in FIG. 6, has been formed with a specific angle θ with respect to the top surface of the maintenance unit cover so that the ultraviolet rays entering from the opening section do not impinge on the end section of the cap base 15, and in addition, the light shut off plate 20 is formed to have larger dimensions than the height and width dimensions of the cap base 15.

Figure 7:
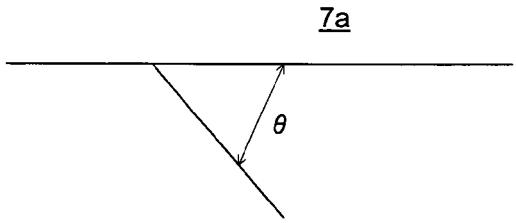
FIGS. 7 (*a*), (*b*) (*c*) and (*d*). An example of the light shutting off plate according to the present invention.
Figure 7:
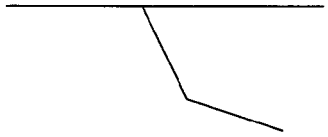
Figure 7:
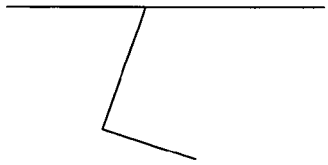
Figure 7:
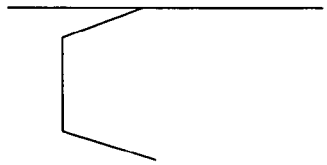

Further, although the light shut off plate 20 shown in FIG. 6 is one that has been formed by bending at a rounded angle with respect to the top surface of the maintenance unit cover, it is not necessary to restrict the present invention to this. For example, as is shown in FIG. 7(*a*), it is also possible to form this by bending at sharp angles to the top surface of the maintenance unit cover, and it is also possible to form this plate by bending it in two or three stages at its middle part, as shown in FIGS. 7(*b*), 7(*c*) and 7(*d*).

Next, the control apparatus in the present preferred embodiment is described below.

The control apparatus is provided with an interface, storage devices such as ROM, etc., and a CPU. The drive units of the recording head and the carriage 4, the ultraviolet ray irradiation apparatus 8, the lift mechanisms, unit transport mechanisms (not illustrated), and suction pumps (not illustrated) of the maintenance units are all connected to the interface.

Further, the CPU of the control apparatus loads the program that has been stored beforehand in the memory circuits in the work area, and by executing various processes according to the program carries out the controls of the lift mechanisms 14, transport mechanisms 21, and suction pumps of the maintenance units 11, of the recording heads 5Y, 6Y, 7Y, 5M, 6M, 7M, 5C, 6C, 7C, and 5K, 6K, 7K, the drive apparatus of the carriage 4, the ultraviolet ray irradiation apparatus 8, etc.

In addition, the inks that can be used in the present preferred embodiment can be any of solvent based inks, water based inks, oil based inks, and photo-hardening type inks, etc. It is preferable that the ink has a viscosity in the range of 10~50 mPa·s at 25° C. and a surface tension in the range of 20~40 mN/m in order for the ink to adhere easily to various types of recording media and not to clog the nozzle of the recording heads.

In particular, it is desirable that the ink is of the photo-hardening type that is used with a wide range of recording media. Even among them, it is desirable that the ink contains cation type ink that can accumulate ultraviolet ray activation energy and gets hardened easily because the light shut off effect of said maintenance apparatus 11 is high for ultraviolet rays and the maintenance can be done definitely. In addition, it is also acceptable to use inks that have additives of photoinitiators thereby having become easier to harden.

The recording medium used in the present preferred embodiment can be any of absorbent type media such as ordinary paper, high quality (bond) paper, glossy paper, etc., or non-absorbent type media such as PVC, glass, metal, etc.

Next, the operation of the ink jet recording apparatus according to the present preferred embodiment is described below.

When a specific image information is input to the control apparatus, the control apparatus controls the transporting apparatus transporting the recording medium along the vertical scanning direction Y and positions it over the platen 9. Next, the inks of different colors are made to be ejected onto the recording medium by operating the recording heads 5Y, 6Y, 7Y, 5M, 6M, 7M, 5C, 6C, 7C, and 5K, 6K, 7K based on the image information while carrying out reciprocating movement of the carriage 4 along the horizontal scanning direction X using the driving apparatus of the carriage. The ink landing on the recording medium is hardened and fixed by the ultraviolet ray irradiation from the ultraviolet ray irradiation apparatus 8, thereby recording the desired image on the recording medium.

After a specific number of images have been recorded, in order to avoid deterioration in the image quality such as due to dot dropouts of the recording heads 5Y, 6Y, 7Y, 5M, 6M, 7M, 5C, 6C, 7C, and 5K, 6K, 7K, the maintenance operations are carried out under the control of the control apparatus in order to carry out maintenance of the recording heads.

Next, the maintenance operation of the present preferred embodiment is described below.

When carrying out maintenance, as is shown in FIG. 6, firstly, the carriage is moved to the maintenance area under the control of the control apparatus, and the nozzle surface of the recording heads 5Y, 6Y, 7Y, 5M, 6M, 7M, 5C, 6C, 7C, and 5K, 6K, 7K is positioned directly above the opening section 19 of the maintenance apparatus 11. The maintenance unit is lowered (in direction Z) using the lift mechanism 14 to the position at which it does not touch the lower end part of the light shut off plate 20, and thereafter, it is moved in the vertical scanning direction Y by means of the unit transporting mechanism (which is not illustrated) thereby positioning each cap base directly under the recording heads 5*y*, 5M, 5C and 5K.

Figure 9:
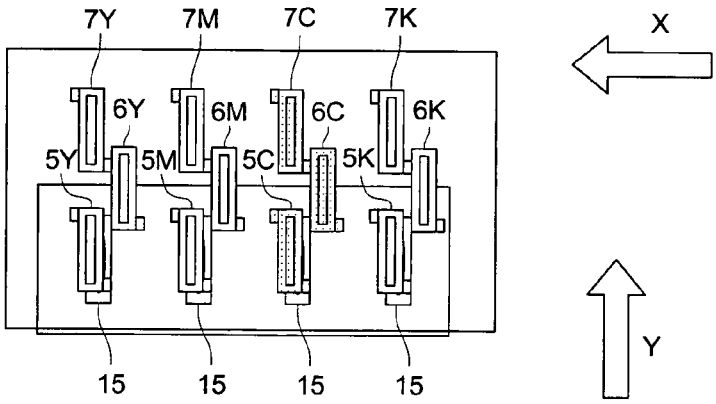
FIG. 9. The outline diagram of the maintenance process of the first row of recording heads according to the present invention.

Thereafter, as is shown in FIG. 9, the maintenance unit is raised using the lift mechanism 14 so that the O-ring of the cap bases 15, 15, . . . gets in close contact with the nozzle surface of the first row of recording heads 5Y, 5M, 5C and 5K, and the suction pump is operated in this condition thereby suctioning ink from the nozzles of the recording heads 5Y, 5M, 5C and 5K for a specific period of time. After stopping the suction pump, the maintenance unit is lowered using the lift mechanism 14 so that it gets separated from the first row of recording heads 5Y, 5M, 5C and 5K.

Figure 10:
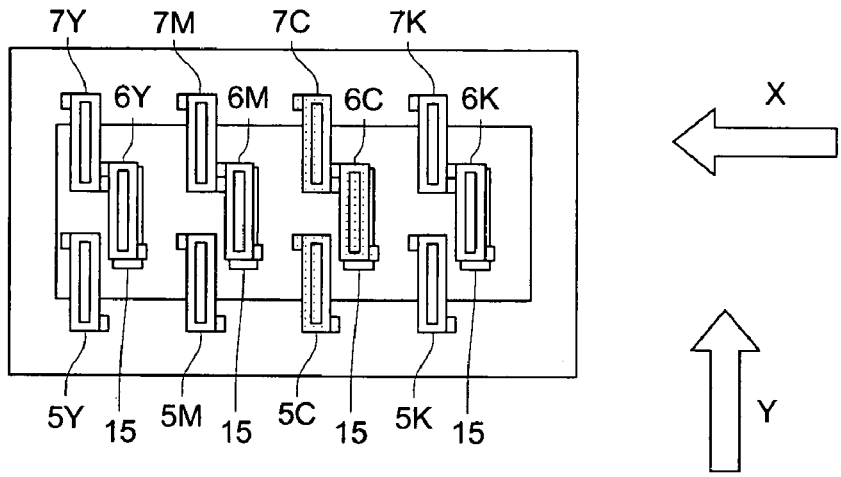
FIG. 10. The outline diagram of the maintenance process of the second row of recording heads according to the present invention.

Next, as is shown in FIG. 10, the carriage 4 is moved in the horizontal scanning direction X using the drive apparatus of the carriage 4 and is stopped when the second row of recording heads 6Y, 6M, 6C and 6K is positioned directly above the opening section 19 of the maintenance apparatus 11. The maintenance unit is then moved using the unit transporting mechanism 21 in the vertical scanning direction Y so that each of the cap bases are positioned directly under the second row of recording heads 6Y, 6M 6C and 6K. Subsequently, the maintenance operation of the second series of recording heads 6Y, 6M, 6C and 6K is carried out by the maintenance apparatus 11 by carrying out the maintenance operations similar to the operation described above.

Figure 11:
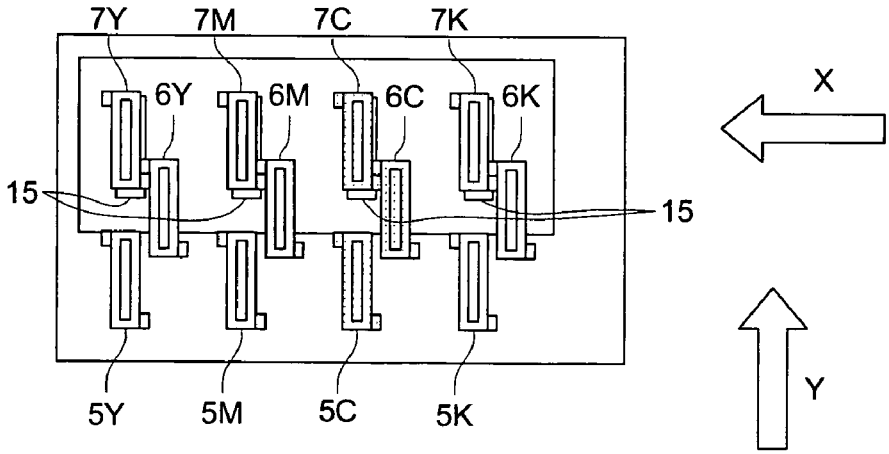
FIG. 11. The outline diagram of the maintenance process of the third row of recording heads according to the present invention.

Next, as is shown in FIG. 11, after the completion of the maintenance of the second series of recording heads 6Y, 6M, 6C and 6K, again under the control of the control apparatus, the carriage is moved to a position at which the third row of recording heads 7Y, 7M, 7C and 7K come directly above the opening section 19, and in this condition, the maintenance operations are made in a manner similar to that described above.

When the maintenance operations for each of the recording heads has been completed, the maintenance unit is lowered using the lift mechanism thereby making the cap bases get separated from the recording heads 7Y, 7M, 7C and 7K. Thereafter, the maintenance unit is moved to the standby position using the unit transporting mechanism 21, and using the lift mechanism 14, it is raised to a position in which the cap bases do not touch the inner side of the top surface of the maintenance unit cover.

After that, the carriage 4 is moved away from the maintenance area and recording of image is done on the next recording medium.

In the above manner, according to the ink jet recording apparatus of the present preferred embodiment, by controlling the maintenance unit using the control apparatus, it is possible to carry out maintenance of three rows of recording heads using only one row of maintenance units. In addition, since the maintenance unit cover 18 is provided in the maintenance apparatus 11 and the light shut off plate 20 is provided in this maintenance unit cover, it is possible to prevent definitely the cap bases 15 from getting exposed to ultraviolet rays emanating from the ultraviolet ray irradiation apparatus 8 and entering through the opening section 19, thereby making it possible to carry out maintenance operations such as suction by the cap base without hardening, particularly, the cation type inks that either get adhered to or remain on the cap base 15.

Because of this, even when carrying out high speed and high image quality image recording, it is possible to carry out maintenance of the recording heads positively, and not only the cost of manufacture of the maintenance apparatus is reduced but also the maintenance apparatus can be made smaller in size.

Further, in order to carry out maintenance much faster, it is possible to provide several rows of maintenance units along the horizontal scanning direction X instead of only one row of maintenance units, or else even only one row can also be provided. Further, it is not necessary to restrict to primary colors of K, C, M, and Y, but also the maintenance units can be provided for secondary or ternary colors.

In addition, the transporting mechanism of the maintenance units can be provided for each maintenance unit or for several units.

Furthermore, the time of starting the recording need not be restricted to the number of times of operation of the recording head, but it is possible use an external input from an input apparatus or to provide an apparatus for recognizing the dirtiness of in recording heads, and also, it is possible to carry out maintenance at the time of starting the operations or at the end of operations, etc.

Effects of the Invention

According to the present invention described in Structure 1, in said maintenance apparatus, because said maintenance unit cover not only has an opening section for making said cap base provided in said maintenance unit to project beyond said maintenance unit cover and to come into close contact with said recording head but also because said opening section is provided with a light shutter plate for shutting off said cap base from the ultraviolet rays emerging from said ultraviolet ray irradiation apparatus, it is possible to shut off the ultraviolet rays from illuminating said cap base and hence there is the effect that it is possible to reduce the hardening of ultraviolet ray hardening type inks that have got adhered to or are remaining on the cap base.

According to the invention described in Structure 2, because said control apparatus is provided that executes the control of making the maintenance of said recording heads to be carried out by moving said maintenance unit of said maintenance apparatus during maintenance to said opening section, it is possible to carry out maintenance more efficiently using lesser number of maintenance units and hence there is the effect of reducing the manufacturing cost of the maintenance apparatus and of making the size of the maintenance unit smaller.

According to the invention described in Structure 3, in said ink jet recording apparatus, because said light shut off plate is provided so as to cover the top surface of said cap base, it is possible to shut off ultraviolet rays from said ultraviolet ray irradiation apparatus of said ink jet recording apparatus or from natural ambient light from impinging on the ink remaining or adhering to said cap base at all times except during maintenance, and hence there is the effect that it is easily possible to reduce the hardening of ultraviolet ray hardening type inks that have got adhered, etc., and to carry out the maintenance operation of suction using the cap base definitely.

According to the invention described in Structure 4, in said ink jet recording apparatus, because said light shut off plate is formed with larger dimensions than the height and width dimensions of said cap base, it is possible to shut off the ultraviolet rays impinging through said opening section, and, in particular, in said ink jet recording apparatus using ultraviolet ray hardening type of inks, it is possible to shut off the ultraviolet rays radiated from said ultraviolet ray irradiation apparatus from impinging on said cap base, and hence there is the effect that it is possible to carry out the maintenance operation of suction using the cap base definitely.

According to the invention described in Structure 5, since said recording head has a configuration of three recording heads arranged in a zigzag manner along the vertical scanning direction Y, it is not necessary to arrange the number of maintenance units corresponding to the recording heads in a zigzag manner making it possible to carry out maintenance with fewer number of said maintenance units, and hence there is the effect of reducing the manufacturing cost of the maintenance apparatus and of making the size of the maintenance unit smaller.

According to the invention described in Structure 6, because said O-ring is provided in said cap base of said maintenance unit for making said cap base come into close contact with said recording head, and because the material used for said O-ring is perfluoro-elastomer, not only the replacement becomes easy but also durability over long periods can be obtained without any melting, bloating up or slipping due to the chemical constituents contained in the ink, and hence there is the effect that it is possible to retain the maintenance performance capacity of the maintenance apparatus over a long period and that it is possible to carry out maintenance definitely.

According to the invention described in Structure 7, in said ink jet recording apparatus, since it is possible to use inks having a viscosity of 10 to 50 mPa·s and a surface tension of 20 to 40 nM/m at 25° C., there is the effect that in the ink jet recording apparatus it is possible to form images on the recording surfaces of a wide range of recording media types.

According to the invention described in structure 8, since in said ink jet recording apparatus it is possible to use inks of the ultraviolet ray hardening type, there is the effect that in the ink jet recording apparatus it is possible to form very good images on the recording surfaces of a wide range of recording media types.

What is claimed is:

1. An ink jet recording apparatus, comprising:

(1) a recording head to eject ink which is hardened by irradiation of ultraviolet rays;

(2) an ultraviolet ray irradiation section to harden the ink ejected from the recording head; and (3) a recording head maintenance device, comprising:

(3-1) a maintenance section for carrying out maintenance of the recording head;

(3-2) a coupling section provided on the maintenance section to make close contact between the recording head and the maintenance section; and (3-3) a cover section which covers the maintenance section, the cover section has an opening section through which the coupling section projects to make close contact with the recording head;

wherein the open section has a light shield section to shield the coupling section from the ultraviolet rays emerging from the ultraviolet ray irradiation section.

2. The ink jet recording apparatus in claim 1, further comprising a control section that controls the maintenance section to move to the opening section and perform maintenance of the recording head.

3. The ink jet recording apparatus in claim 1, wherein the light shield comprises a light shut off plate that covers a top surface of the coupling section.

4. The ink jet recording apparatus in claim 3, wherein the light shut off plate is formed with larger dimensions than height and width dimensions of the coupling section.

5. The ink jet recording apparatus in claim 1, wherein three recording heads are arranged in a zigzag manner in vertical scanning direction Y.

6. The ink jet recording apparatus of claim 1, wherein the coupling section includes a sealing member for making close contact between the coupling section and the recording head, and wherein the sealing member is formed of perfluoro-elastomer.

7. The ink jet recording apparatus in claim 1, wherein the ink having a viscosity of 10 to 50 mPa·s and a surface tension of 20 to 40 mN/m at 25° C. is used.

8. The ink jet recording apparatus in claim 1, wherein the ink used is of the ultraviolet ray hardening type.

* * * * *